United States Patent [19]

Mouyard et al.

[11] 4,345,308

[45] Aug. 17, 1982

[54] ALPHA-NUMERIC DISPLAY ARRAY AND METHOD OF MANUFACTURE

[75] Inventors: Arthur A. Mouyard, Glendale Heights; Michael V. Hamby, Chicago; Paul A. Tomaszek, Des Plaines, all of Ill.

[73] Assignee: General Instrument Corporation, Clifton, N.J.

[21] Appl. No.: 196,452

[22] Filed: Oct. 14, 1980

Related U.S. Application Data

[62] Division of Ser. No. 936,728, Aug. 25, 1978, Pat. No. 4,254,453.

[51] Int. Cl.[3] ..... F21V 5/00

[52] U.S. Cl. ..... 362/332; 362/245; 362/246; 362/330

[58] Field of Search ..... 362/11, 17, 227, 244, 362/240, 238, 241, 236, 237, 239, 245, 246, 330, 331, 332, 338, 800; 40/550; 313/111, 500, 114

[56] References Cited

U.S. PATENT DOCUMENTS

| | | | |
|---|---|---|---|
| 3,821,590 | 6/1974 | Kosman | 362/800 |
| 4,185,891 | 1/1980 | Kaestner | 362/800 |
| 4,254,453 | 3/1981 | Mouyard | 362/241 |

*Primary Examiner*—Donald P. Walsh
*Attorney, Agent, or Firm*—Mason, Kolehmainen, Rathburn & Wyss

[57] ABSTRACT

An alpha-numeric array is provided for the selective display of characters as controlled by associated character generator programming circuitry. The display array in one character format utilizes a 5×7 matrix array of individually operable illumination sources, LED solid state lamps for example, with programmed combinations of the individual illumination sources being operated to display the programmed characters. The display array includes a lens and front panel array having integrally formed lens areas. The lens areas of the lens and front panel array when unactuated are essentially indistinguishable from the front panel array background area thus providing improved contrast. The display array also includes a reflector array having integrally formed reflector cavities. The integrally formed reflector cavities include predetermined surface characteristics for collimating the light rays emanating from the central axis of the reflector cavities. The display array also includes an illumination source alignment and mounting array having integrally formed illumination source mounting arrangements and integrally formed illumination source alignment arrangements.

5 Claims, 12 Drawing Figures

FIG. 1
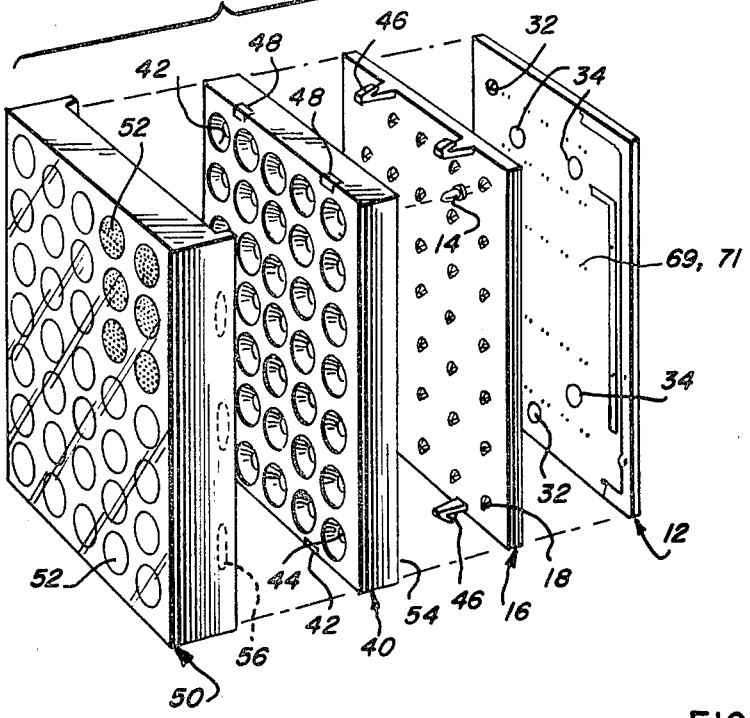
FIG. 9
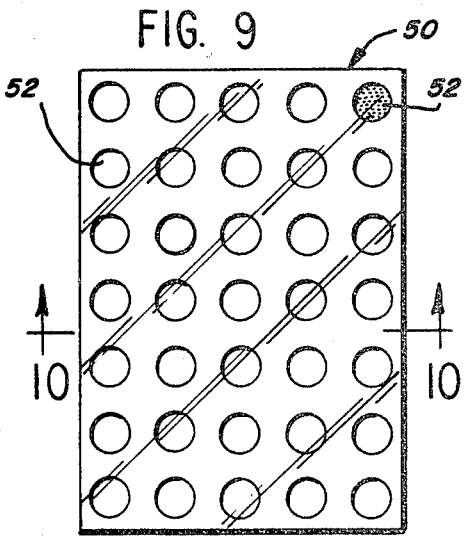
FIG. 11
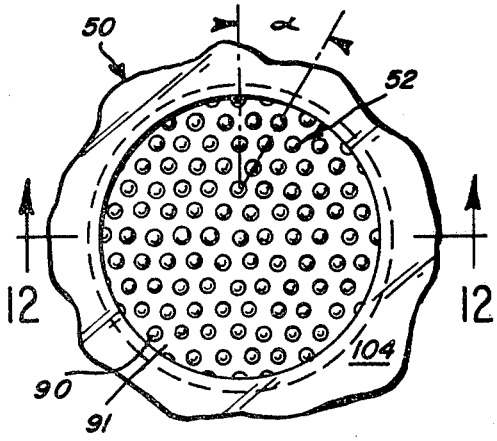
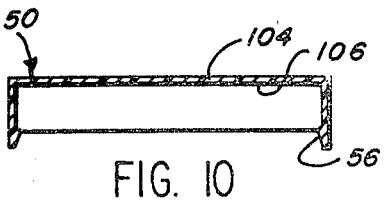
FIG. 10
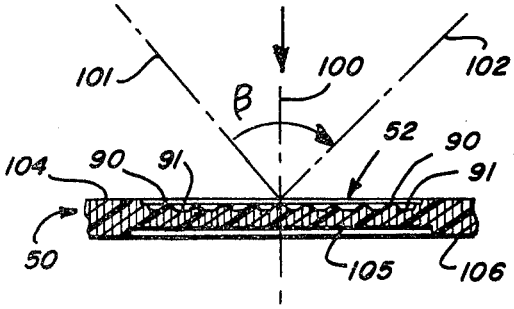
FIG. 12

FIG. 6
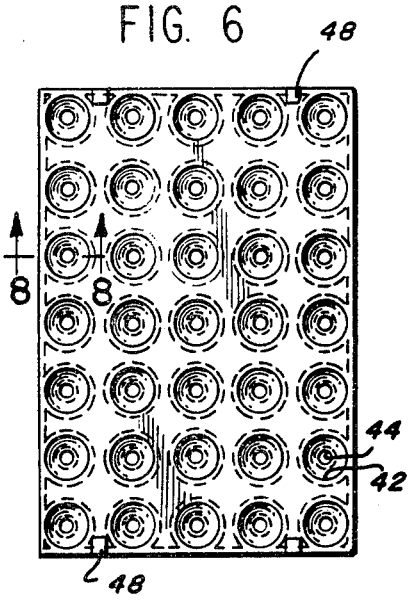
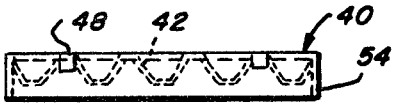
FIG. 7
FIG. 8
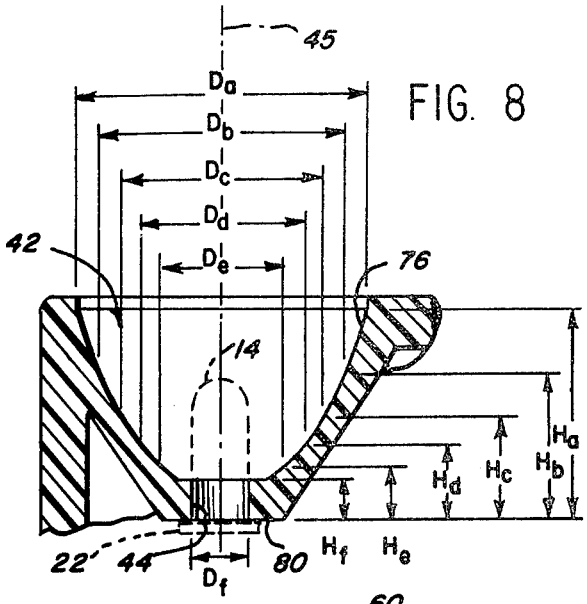
FIG. 5
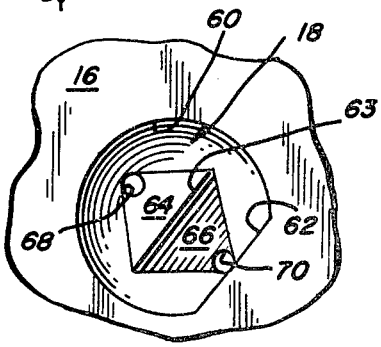
FIG. 2
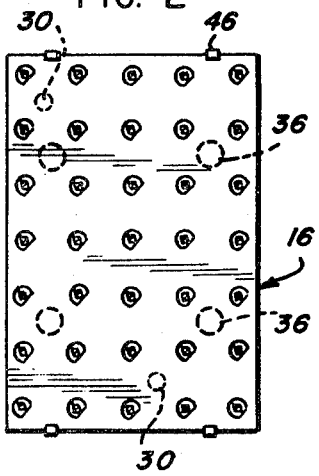
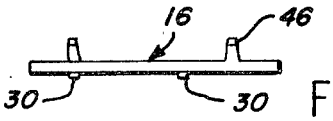
FIG. 3
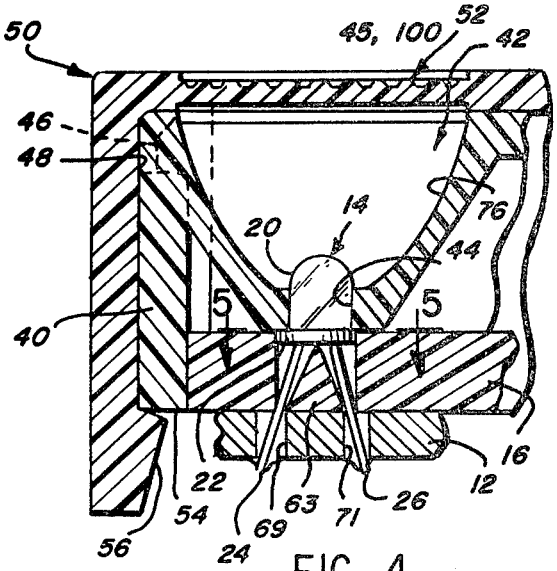
FIG. 4

ALPHA-NUMERIC DISPLAY ARRAY AND METHOD OF MANUFACTURE

This is a division of application Ser. No. 936,728, filed Aug. 25, 1978, now U.S. Pat. No. 4,254,453.

BACKGROUND OF THE INVENTION

A. Field of the Invention

The present invention relates generally to the field of display devices and more particularly to an alpha-numeric display array or character display having a predetermined pattern or matrix array of M columns by N rows of individually actuable illumination sources. The alpha-numeric display array is utilized either singly for the display or presentation of individual characters or for use in combination with other similar displays for messages, moving displays and the like.

B. Description of the Prior Art

Various alpha-numeric display arrays are available for the presentation of characters and messages. Typically the display array is formed by one or more individual display arrays each including a 5×7 array of individually actuable illumination sources to accurately depict character representations and messages. For example, one standard format provides for the generation of the 64 characters of the ASCII system. These display arrays are controlled by suitable character generator control circuitry to display predetermined messages by appropriately and selectively controlling the actuation of the predetermined matrix or array positions of each of the display arrays to display the appropriate character for a predetermined time duration.

One alpha-numeric display array of this general type is the "DATABLOX" display manufactured and sold by Chicago Miniature Lamp Works of the General Instrument Corporation located at 4433 North Ravenswood Ave., Chicago, Ill. 60640. This particular display generates a character approximately 4 inches in height and includes a five column by seven row array. This display array is assembled by the insertion and mounting of 35 individual, encapsulated LED sources in an appropriate array on a printed circuit card. This is accomplished by insertion of the device leads of each of the individual LED sources through alignment holes in the printed circuit card. After insertion, the leads of the LED sources are soldered. The printed circuit card includes conductive plating paths to form a control matrix for the LED sources. Next in the assembly process, an individual reflector assembly is positioned over each of the 35 mounted, LED sources. Further, an individual lens cap is attached over the top of each reflector assembly. The printed circuit card including mounted LED sources, reflector assemblies and lens caps is then inserted into a display front panel. The display front panel includes a front panel surface provided with an array of 35 spaces or holes adapted to interfit with the lens caps of each of the array positions. The front panel surface for example is fabricated from metal with the lens holes being stamped or cut therethrough. The front panel surface is finished with a generally nonreflective surface or coating. The lens caps are typically fabricated from a plastic material such as red, yellow or green plastic. Thus, the individual lens caps protrude and the array of lens caps are visible on the front panel of the display array. The PC board includes output connections for interconnection to character generator control circuitry.

While the display arrays of the prior art are generally suitable for their intended use, it would be desirable to improve operational characteristics and to improve the appearance and display quality of display arrays. Further, it would be desirable to simplify the manufacture and assembly of display arrays. For example, the appearance of the display array exhibits certain limitations from the standpoint of glare and reflective characteristics, field of vision characteristics and the general contrast of the overall display between the actuated and unactuated portions. Specifically, the lens caps of the unactuated array positions are readily visible under various viewing conditions in contrast to the background portions of the display array. The distinctiveness of the unactuated lens caps also results in a reduction in contrast with respect to the actuated array positions. In addition to the individual lens array positions standing out or being readily discernable against the contrasting background, contrast is also reduced in bright ambient light conditions due to reflections from the top surface of the unactuated lens positions.

Further, the assembly and manufacture of display arrays from individual component parts requires many individual steps of assembly and the assembly of a large number of individual parts. In addition, the assembly of the individual component parts does not optimize the desired predetermined relationship of the component parts and requires a high degree of labor skill by assembly personnel. For example, the encapsulated LED packages must be individually inserted with the leads of the LED passing through the printed circuit card and the LED source being positioned as closely as possible to the surface of the printed circuit card for proper alignment and maximum output efficiency. However, no matter how careful and skilled the assembly personnel, the consistency of such operations is not high and the positioning of each LED source is not highly accurate. Further, the LED sources mounted on the printed circuit board are not provided with a high degree of thermal insulation. Thus, thermal stressing of the LED chip bond can result in chip failure due to heat induced damage of the fine wire bonds on the LED chip during soldering operations of the printed circuit card. The manufacture and assembly of the 35 individual reflectors and lens caps and their attachment to the display array also involves a high degree of skill, increased handling costs and increased assembly labor.

SUMMARY OF THE INVENTION

Accordingly, it is a principal object of the present invention to provide an improved display array that is efficiently manufactured from a minimum number of easily assembled components and results in a display array having improved operating characteristics and display quality.

It is another object of the present invention to provide a display array including a lens and front panel array that is fabricated as a unitary component part with integral lens areas forming an array.

It is a further object of the present invention to provide a display array including a reflector array that is fabricated as a unitary component part with integral reflector cavities for each array position of the display array.

It is a further object of the present invention to provide a display array including an illumination source alignment and mounting array having integrally formed source alignment arrangements and source mounting arrangements for each of the illumination sources; the alignment and mounting array providing for ease of assembly and manufacture in the insertion and mounting of the illumination source devices of the display array and also providing accurate positioning of each of the illumination sources in the overall display array.

It is another object of the present invention to provide an improved display array having a wide angle viewing characteristic, maximized light output efficiency, and improved nonglare and non-reflective characteristics; the improved characteristics being provided by the individual component parts and their assembly.

It is a still further object of the present invention to provide an improved display array wherein a minimum number of component parts are utilized to efficiently assemble the display array; the component parts including arrangements to provide accurate positioning and alignment of the illumination sources, reflectors and lens assemblies of the display array.

Briefly, in accordance with an important aspect of the present invention there is provided an improved display array for the selective display of characters as controlled by associated character generator programming circuitry. The display array in one character format utilizes a 5×7 matrix array of individually operable illumination sources, LED solid state lamps for example, with programmed combinations of the individual illumination sources being operated to display the programmed characters.

The display array includes a lens and front panel array having integrally formed lens areas. The lens and front panel array in a preferred arrangement is fabricated as a unitary component part, for example by an injection molding operation. The lens and front panel array is fabricated with integral glare reducing characteristics, wide angle viewing characteristics and contrast enhancement characteristics. The lens areas of the lens and front panel array when unactuated are virtually indistinguishable from the front panel array background area thus providing improved contrast. The display array also includes a reflector array having integrally formed reflector cavities. The reflector array in a preferred arrangement is also fabricated as a unitary component part by an injection molding operation. The integrally formed reflector cavities include predetermined surface characteristics for collimating the light rays emanated from the central axis of the reflector cavities. The display array also includes an illumination source alignment and mounting array having integrally formed illumination source mounting arrangements and integrally formed illumination source alignment arrangements. The illumination source mounting and alignment array in a preferred arrangement is fabricated as a unitary component part by an injection molding operation.

The illumination source mounting arrangements and the illumination source alignment arrangements control the accurate positioning of the illumination sources in the display array and provide for ease of assembly.

To assemble the display array, a printed circuit card or substrate of the display array is attached to the bottom surface of the alignment and mounting array. Next the individual illumination sources are inserted into the respective individual alignment and mounting arrangements in the alignment and mounting array. Device lead projecting from the bottom of the illumination sources extend through corresponding alignment holes of the alignment and mounting array and through the printed circuit card. To continue the assembly of the display array, the alignment and mounting array with attached printed circuit card and inserted illumination sources is assembled into the reflector array. The source alignment and mounting arrangements of the illumination source alignment and mounting array controls the positioning of the illumination sources with predetermined body portions of each of the illumination sources extending into respective individual reflector cavities in a predetermined relationship with the corresponding reflector cavity to achieve maximum efficiency of light output and collimation of the light rays from the illumination sources. The reflector array and the alignment and mounting array are provided with interfitting structures for attachment in a predetermined relationship for proper alignment between each reflector cavity in the array and the respective aligned illumination source. At this point in the assembly of the display array, the device leads of the illumination sources projecting through the bottom of the printed circuit card are trimmed to a predetermined length, if required, and the entire bottom surface of the printed circuit card is wave soldered. The partially assembled display array is then electrically tested. To complete the assembly of the display array, the reflector array with the attached alignment and mounting array and the printed circuit card are attached to the lens and front panel array by a predetermined mounting arrangement for providing alignment of the lens areas of the lens and front panel array and the reflector cavities of the reflector array.

The invention both as to its organization and method of operation together with further objects and advantages thereof will be best understood by reference to the following specification taken in connection with the accompanying drawings:

BRIEF DESCRIPTION OF THE DRAWINGS

FIG. 1 is an exploded perspective representation of the display array of the present invention and illustrating the interfitting and assembly of various component parts of the display array of the present invention.

FIG. 2 is a plan view of the illumination source alignment and mounting array of the display array of FIG. 1;

FIG. 3 is a front elevational view of the illumination source alignment and mounting array of FIG. 2;

FIG. 4 is an enlarged, fragmentary sectional view of a portion of the assembled array of FIG. 1 illustrating the relationship and positioning of the component parts of the display array of the present invention;

FIG. 5 is a partial elevational view taken from the line 5—5 of FIG. 4 and illustrating features of the illumination source alignment and mounting array;

FIG. 6 is a plan view of the reflector array of the display array of FIG. 1;

FIG. 7 is a front elevational view of the reflector array of FIG. 6;

FIG. 8 is an enlarged, fragmentary sectional view through an individual reflector assembly of the reflector array taken along line 8—8 of FIG. 6;

FIG. 9 is a plan view of the lens and front panel array of the display array of FIG. 1;

FIG. 10 is a sectional view of the lens and front panel array taken along the line 10—10 of FIG. 9;

FIG. 11 is an enlarged, fragmentary view of a portion of the lens and front panel array of FIG. 9 and illustrating an individual lens area of the lens and front panel array; and FIG. 12 is a sectional view of a lens area taken along line 12—12 of FIG. 11.

DESCRIPTION OF THE PREFERRED EMBODIMENT

Referring now to the drawings and particularly to FIG. 1, the display array of the present invention generally referred to at 10 and its component parts are illustrated in a disassembled condition. In the specific embodiment illustrated in FIG. 1, a five column by seven row display array 10 is illustrated for operation as a display for conventional character generation.

The display array 10 includes a printed circuit card or substrate 12 having conductive plating on one or more surfaces to define electrical interconnections of the array circuitry after assembly. The printed circuit card 12 also includes a predetermined pattern of lead holes for receiving leads or lead wires of inserted components. The holes in the printed circuit card 12 in a specific embodiment are plated through holes to form electrical connections between conductive plating paths on both surfaces of the printed circuit card 12.

The operational illumination characteristics of the display array 10 are provided by a predetermined number of individual illumination sources 14. Considering the specific embodiment of FIG. 1, an illumination source 14 is provided for each array position of the 5 column by 7 row display array 10. The display array 10 also includes an illumination source alignment and mounting array referred to generally at 16. The illumination source alignment and mounting array 16 has the general form of a thin rectangular plate or spacer. During the assembly of the display array, the illumination sources 14 are inserted into the illumination source alignment and mounting array 16. The alignment and mounting array 16 includes a row by column matrix array of alignment and mounting arrangements referred to generally at 18. The array of alignment and mounting arrangements 18 corresponds to the desired display format as viewed from the front of the completed and assembled display array 10; a 5×7 array for the specific embodiment of FIG. 1. Each of the alignment and mounting arrangements 18 includes a predetermined structure for receiving a respective illumination source 14 and providing predetermined alignment and mounting characteristics as will be explained in detail hereinafter.

The illumination sources 14 in a specific preferred embodiment are LED (light emitting diode) packages or solid state lamps which are typically fabricated by the encapsulation of an LED chip with attached leads or lead wires. The leads are typically attached to the LED chip by wire bonding or other techniques.

Referring now additionally to FIG. 4, each of the illumination sources 14 in a specific preferred embodiment is an encapsulated LED device including a body 20 having a dome-shaped top and a lower base flange 22 at the base of the cylindrical body portion 20. Device leads 24, 26 extend from the base of the LED device 14 for accomplishing electrical and mechanical connections. The illumination source 14 in a specific embodiment is a Chicago Miniature Lamp Works part number CM4-244 solid state lamp. The illumination source is approximately the size of a standard ANSI T-1 component package outline. The overall height of the body portion 20 including the base flange 22 is 0.190–0.210 inch (4.83–5.33 mm) and the approximate thickness of the base flange 22 is 0.020 inch (0.508 mm). The diameter of the body portion 20 is 0.115–0.130 inch (2.92–3.30 mm). The diameter of the base flange 22 is 0.150–0.160 inch (3.81–4.06 mm). The base flange 22 also includes a flattened side for orientation and identification purposes. The leads 24, 26 are approximately 0.014 inch square (0.076 mm) and 0.500 to 1.000 inch long (15.2–25.4 mm). The above dimensions of a specific illumination source 14 are given for illustrative purposes only in the explanation of the present invention and are not to be interpreted in a limiting sense. The present invention contemplates the use of illumination sources having various shapes and dimensions with suitable modifications to the various component parts of the display array 10. The material utilized in the encapsulation of the illumination source has light transmissive characteristics and in specific embodiments is an epoxy formulation. The color of the encapsulation material is red, green, yellow or orange.

Considering now the assembly of the display array 10 and referring now additionally to FIGS. 2–5, the printed circuit card 12 is affixed to, accurately positioned with and aligned with the source alignment and mounting array 16 by the interference fit of a predetermined number of ribbed bosses or pins 30 extending from the lower surface of the source alignment and mounting array 16 into corresponding holes 32 in the printed circuit card 12. The assembled illumination source alignment and mounting array 16 and the printed circuit card 12 are arranged in suitable fixturing (not shown) to simplify additional manufacturing and assembly steps including the insertion of the illumination sources 14 into the source alignment and mounting array 16. The fixturing in a specific embodiment includes fixture positioning and support pins that protrude through a predetermined number of holes 34 in the printed circuit card 12 and into a corresponding number of circular recesses 36 extending into the bottom surface of the source alignment and mounting array 16.

The illumination sources 14 are individually inserted into the alignment and mounting arrangements 18 in the source alignment and mounting array 16. During insertion of the illumination sources 14, the leads 24, 26 of each of the illumination sources 14 are aligned and pass through holes in the source alignment and mounting array 16 and through respective aligned holes in the printed circuit card 12. The alignment and mounting arrangements 18 provide predetermined alignment and positioning characteristics for the illumination sources 14, provide alignment of the leads 24, 26 into the respective receiving holes through the printed circuit board 12, and allow rapid and simplified insertion of the illumination sources 14 during assembly.

After the predetermined array of illumination sources 14 have been inserted into the alignment and mounting receptacles 18, the illumination sources 14 are appropriately aligned and positioned in the predetermined array pattern and are provided with a predetermined resilient characteristic by the alignment and mounting arrangements 18. The predetermined resilient characteristics in a specific embodiment is a predetermined spring rate provided by the leads 24, 26 in the alignment and mounting receptacles 18 in response to a vertical force being applied in compression to the base flange 22 of the illumination sources 14.

Referring now additionally to FIGS. 6 and 7, the display array 10 includes a reflector array 40 having an array of integrally formed reflector cavities or surfaces 42. The array of reflector cavities or surfaces 42 on the reflector array 40 is identical to the predetermined array of the display array 10; i.e. the same array pattern as provided on the illumination source alignment and mounting array 16.

Considering the further assembly of the display array 10, the reflector array 40 is positioned over the illumination source and mounting array 16. The illumination sources 14 protruding from the illumination source alignment and mounting array 16 are aligned with and pass into the respective reflector cavities 42 through holes 44 centrally located at the bottom of each of the reflector cavities 42. The reflector array 40 and the illumination source alignment and mounting array 16 are interlocked in a predetermined interrelationship by the interfitting of portions of a predetermined number of extending tab arms 46 formed on the illumination source alignment and mounting array 16 and respective notches 48 formed in the reflector array 40. The predetermined positional interrelationship of the reflector assembly 40 and the illumination source alignment and mounting array 16 provided by the interlocking relationships of the tab arms 46 within the notches 48, the dimensioning of the reflector cavities 42, the illumination sources 14 and the alignment and mounting arrangements 18 determine the accurate positioning and retention of the illumination sources 14 in the reflector cavities 42. This further simplifies assembly and handling of the display array 10 before the soldering of the leads 24, 26 of the illumination source 14. That is, before the soldering of the leads 24, 26, the leads 24, 26 are not required to be crimped or bent for retention of the illumination sources 14 and further, no retention or holding force by assembly personnel or external apparatus is required during soldering of the leads 24, 26 either during a wave soldering operation or individual lead soldering operations if a wave soldering operaton is not utilized.

Next in the assembly process, the leads 24, 26 of the illumination sources 14 extending through the bottom surface of the printed circuit card 12 are appropriately trimmed and the entire printed circuit card processed through a wave soldering operation. At this point in the assembly of the display array 10, the operational characteristics are electrically tested and visually observed by attachment to an appropriate test fixture (not shown) by interconnection of the test fixture to the printed circuit card 12. The printed circuit card 12 includes a connector arrangement. In specific embodiments, the connector arrangement is a series of extending connector pins or an edge connector.

To complete the assembly of the display array 10 and referring now additionally to FIGS. 9 and 10, the display array 10 includes a lens and front panel array 50 having a predetermined array of integral lens areas 52 in the same arrangement corresponding to the array of the illumination sources 24. The lens and front panel array 50 is assembled over the reflector array 40 with the bottom edge 54 of the sidewall of the reflector array 40 interlocking with a predetermined number of extending ribs 56 protruding inwardly from the sidewalls of the lens and front panel array 50. In the assembled display array 10, the lens areas 52, the reflector cavities 42, and the illumination sources 14 are properly positioned in a predetermined relationship illustrated in FIG. 4 to optimize the transmission of the illumination output of the sources 14 and to provide predetermined operational characteristics.

Considering now the details of the illumination source alignment and mounting array 16 and referring now to FIGS. 4 and 5, each of the alignment and mounting arrangements 18 includes a circular recessed portion providing a recesed base flange reference surface 60. The circular recessed portion and the base flange reference surface 60 includes a flattened orientation edge 62 that is arranged to interfit and orientate the base flange 22 of the illumination source 14. The alignment and mounting arrangements 18 also includes a spreading wedge generally referred to at 63 extending below the base flange reference surface 60 across the thickness of the illumination source alignment and mounting array 16. The spreading wedge 63 includes and defines two triangular wedge surfaces 64 and 66. The triangular wedge surfaces 64 and 66 are each arranged with the vertex at the bottom of the alignment and mounting arrangement 18. Thus, the triangular wedge surfaces (FIG. 4) slope or are inclined outwardly and downwardly through the alignment and mounting arrangement 18. The vertex of each of the triangular surfaces 64 and 66 includes a lead alignment hole 68, 70 respectively to receive a respective one of the lead wires 24, 26 of the illumination source 14.

Thus, the spreading wedge arrangement 63 aligns and orientates the leads 24, 26 upon insertion of the illumination source 14 with the leads 24, 26 being directed down along the triangular wedge surfaces 64, 66 respectively and through the lead holes 68, 70 respectively. Thus, the spreading wedge arrangement 63 greatly simplifies the assembly phase of inserting the illumination source 14. The diameter of the lead holes 68, 70 are a predetermined dimension larger than the thickness of the lead wires 24, 26. Upon insertion of the illumination source 14 the lead wires 24, 26 are deformed outwardly from their spacing before insertion. The spacing of the lead alignment holes is a predetermined dimension larger than the undeformed spacing of the leads 24, 26. Thus, the deformation or spreading of the lead wires 24, 26 provides a predetermined spring characteristic or resiliency factor to the illumination source 14 upon a compressive force being applied to the body flange 22 of the illumination source 14. The recess flange surface 60 provides a "bottoming-out" reference plane for the bottom surface of the flange 22 of the illumination source 14 to determine accurate positioning of the illumination source 14 and a limit to the assembled position of the illumination source 14 in combination with the predetermined spring rate characteristic provided by the spreading wedge 63 and the leads 24, 26. In a specific preferred embodiment, the illumination source alignment and mounting array 16 is fabricated in an injection molding operation with integrally molded alignment and mounting arrangements 18, tab arms 46, circular recesses 36 and bosses 30.

Referring now to FIGS. 6, 7 and 8 and considering the details of the reflector array 40, in a specific preferred embodiment the reflector array 40 is fabricated in an injection molding operation with an integrally molded and defined array of reflector cavities 42 each having an internal reflector surface 76 having predetermined focal characteristics and a central opening 44 for receiving the body portion 20 of the illumination source 14.

In accordance with an important aspect of the present invention, the internal reflector surface 76 is a variable focus parabolic surface or surface of a paraboloid; i.e. a series of parabolic surfaces each having a different focal point or focus along a central axis 45 through the reflector cavity 42. The reflector cavity surface 76 is defined to collect and collimate light rays emanating from various points along the central axis 45 into a beam or column of light rays parallel to the central axis 45. The variable curvature parabolic reflector surface 76 accounts for the departure of the illumination source 14 from a theoretical point source and accounts for the actual emanation from the illumination source 14 being at various points along the central axis 45. In effect, the point on the reflector surface 76 collimates light rays emanating from the illumination source along the central axis 45. Thus, light output efficiency is maximized, internal reflection is minimized and a collimated light beam is effected. The cause of the illumination source 14 not being a point source is the refraction that occurs of the light rays emanating from the LED chip at the interface between the encapsulation material of the body 20 and the environment (air) outside the body 20. The following table of dimensions of the reflector surface 76 identified in FIG. 8 and defining the reflector cavity 42 is listed herein as in illustrative example of one specific embodiment in accordance with the principles of the present invention and should not be interpreted in a limiting sense:

| | D—Diameter inches (mm) | H—Height inches (mm) |
|---|---|---|
| a | .400 (10.16) | .284 (7.21) |
| b | .338 (8.59) | .200 (5.08) |
| c | .279 (7.09) | .140 (3.56) |
| d | .225 (5.72) | .100 (2.54) |
| e | .169 (4.29) | .070 (1.78) |
| f | .132 (3.35) | .057 (1.45) |

In addition to the collimation of light rays that emanate from the illumination source and is reflected by the reflector surface 76, light also is transmitted directly from the illumination source 14 without reflection and directly out from the reflector cavity 42 generally along the central axis 45. During fabrication of the reflector array 40, the reflector cavity surfaces 76 are finished in a specific embodiment to a 2 microinch surface and plated with a silver reflective coating. The finish on the areas 41 of the top surface of the reflector array between the reflector cavities 42 is a heavy matte finish to render these areas nonreflective.

Upon assembly of the reflector array 40 over the illumination source alignment and mounting array 16, the illumination sources 14 enter and protrude into the reflector cavities 42 in a predetermined positional relationship with respect to the outer bottom surface 80 of the reflector cavity 42. Specifically the top surface of the flange 22 of the light illumination source 14 (shown in phantom in FIG. 8) is positioned in contact with the bottom surface 80 upon the interlocking of the extending tab arms 46 of the illumination source alignment and mounting array 16 through the notches 48 of the reflector array 40. In accordance with the predetermined dimensional interrelationships of the illumination source alignment and mounting array 16 and the reflector array 40, the base surface 80 of the reflector array contacts the flange 22 of the LED source to appropriately position the extending body portion 20 of the LED source into the reflector cavity 42 for optimization of light output and the operating characteristics of the display array. In a specific embodiment corresponding to the table values of the reflector cavity dimensions, the body 20 of the illumination source 14 extends approximately 0.120 inch (3.048 mm) into the reflector cavity 42 or the height of the body portion 20 approximately 0.200 inch (5.08 mm), as measured from the bottom reference surface 80. Further, the diameter of the base flange reference surface 60 is 0.1775 inch (4.51 mm) and the depth of the base flange reference surface 60 is located 0.020 inch (0.51 mm) below the surface of the illumination source alignment and mounting array 16.

In accordance with important aspects of the present invention and upon assembly of the display array 10, the predetermined resilient mounting characteristic provided by the spreading wedge 63 and the leads 24, 26 positions the base flange 22 of the illumination source 14 against the bottom surface 80 of the reflector array 40 as force is applied against the flange by the surface 80 during assembly. As force is applied to the base flange 22 by the surface 80, the base flange 22 in accordance with the resilient mounting force exerted by the leads 24, 26 moves farther down into the circular recess 60. The interdimensional relationships, the alignment and mounting arrangements 18, the illumination sources 14 and the reflector array 40 are determined and fabricated to ensure contact or in the worst case a small predetermined clearance between the top of the base flange 22 of the illumination source 14 and the base reference surface 80 of the reflector array 40 upon assembly of the display array 10. At this point in the assembly of the display array 10 and as discussed hereinbefore, the leads 24, 26 extending through the printed circuit card 12 are appropriately trimmed and the entire bottom surface of the printed circuit card 12 is wave soldered. It should be noted that the illumination sources 14 and the encapsulated chip portions thereof are thermally isolated and removed from the close proximity of the wave soldering operation to thus reduce heat induced damage from the wave soldering operations. Further, the alignment and mounting arrangements 18 provide orientation and positioning of the illumination sources 14 within the display array 10 and into the holes in the printed circuit card board 12. If the lead holes 69, 71 in the printed circuit card 12 were utilized to orientate the illumination source 14, the lead holes 69, 71 would of necessity be smaller than provided by the present invention for appropriate alignment determination and would also be much closer spaced. In accordance with the present invention, the provision of the illumination source alignment and mounting array 16 spaces the illumination sources 14 from the printed circuit card 12 by the thickness of the illumination source alignment and mounting array 16. Thus, the lead holes 69, 71 are more widely spaced as illustrated in FIG. 4 by the inclined leads 24, 26 to aid in reducing solder bridging problems during wave soldering operations. In a specific embodiment the lead wire spacing 24, 26 at the exit from the base flange 22 of the illumination sources 14 is approximately 0.055 inch (1.40 mm) and at the entrance to the printed circuit card 12 the spacing of the leads 24, 26 is approximately 0.125 inch (3.18 mm) and the center to center spacing of the lead holes 69, 71 is thus approximately 0.125 inch.

In accordance with important aspects of the present invention and referring now to FIGS. 9 through 12, the lens and front panel array 50 in a specific preferred embodiment is fabricated in an injection molding operation with an integrally molded and defined array of lens areas 52. Referring particulary to FIGS. 11 and 12, each of the lens areas 52 includes a predetermined pattern of raised spherical sections or portions of spheres 90. The predetermined pattern of raised spherical sections 90 includes the definition of the predetermined spacing, radius of curvature and height of the spherical sections 90. The height of the spherical sections 90 is defined as the distance the spherical section 90 extends above the reference surface 91 between the raised spherical sections 90. The ratio of the height of the spherical sections 90 to the radius of curvature of each raised spherical section 90 determines the optimization of light output and the total viewing angle $\beta$ from the front of the display array 10 as measured from a central axis 100 of the lens area 52. The viewing angle $\beta$ is defined between the axes 101, 102 about the central axis 100. The central axis 100 of the lens area 52 coincides with the central axis 45 of the reflector cavities 42 as shown in FIG. 4. The inside (bottom) surface 106 and the outside (top) surface 104 of the lens array 50 between the lens areas 52 is a heavy matte finish. The inside (bottom surface 105 of the lens areas 52 and the outside (top) surface of the lens areas including the reference surface 91 between the spherical sections and the spherical sections 90 in a specific preferred embodiment are a smooth finish specified as a two microinch finish or highly polished surface.

In accordance with an important aspect of the present invention and in a specific preferred embodiment, the lens and front panel array 50 is injection molded with the molding operation defining the parameters, structural relationships and dimensions of the lens array 50 without further finishing or tooling operations being required. The matte finish on the surface 104, 106 reduces glare (reflective) effects as does the location of the raised spherical sections 90 on the outer surface of the lens array 50 that defines the viewed surface of the display array 10 indicated by the arrow along the axis 100.

The relative spacing of the spherical sections 90 is determined by the desired distribution of the light output across the viewing angle. While a viewing angle $\beta$ is described, it should be realized that the transmitted illumination beam emanating from the lens area 52 describes the volume of a cone formed by the revolution of the axes 101, 102 about the central axis 100. A relatively equal surface area distribution of raised spherical sections 90 and flat portions 91 results in a nearly uniform distribution of light output across the viewing angle $\beta$ with the exception of the transmitted light output from the illumination source 14 that is transmitted directly out the lens area 52 and is not reflected and collimated by the reflector cavity 42. This results in an increased on-axis concentration of light output along the axis 100. In specific dislay array applications and embodiments, the increased concentration of on-axis light output is desirable. In other applications, the increased concentration of on-axis light output is reduced in specific embodiments by the provision of a higher concentration of spherical sections 90 in the center portion of the lens area 52. In a specific preferred embodiment, the viewing angle $\beta$ is approximately 90° to achieve a 45° viewing angle to either side of the central axis 100. The size of each spherical section 90 is determined by the practical considerations of achieving a readily manufacturable mold cavity that accurately describes the spherical sections 90. In a preferred specific embodiment, the radius of curvature of the spherical sections 90 is 0.020 inch (0.52 mm), the height of the spherical sections 90 is 0.004–0.005 inch (1.10 to 0.13 mm), and the pattern of spherical sections 90 is defined by the rows of spherical sections identified by the angle $\alpha$ equal to 30° in FIG. 11. In an alternative specific embodiment, the spherical sections 90 are formed on the lower surface 105 of the lens areas 52 and the top surface of the lens areas 52 is flat. However, in that specific embodiment the non-reflective glare reducing characteristics would not be achieved.

In accordance with important aspects of the present invention, the ratio of the height of the spherical sections 90 to the radius of curvature of the spherical sections 90 is determined in accordance with the desired total viewing angle $\beta$ and the amount of light transmittance through the lens areas 52 relative to the light reflected back into the lens. The mathematical relationship for determining the maximum amount of light transmittance and maximum viewing angle $\beta$ is derived from trigonometric relationships and Snell's law with the following result:

$$h = R\,(1 - \sqrt{1 - (N_E/N_I)^2}\;;$$

where h is the height of the spherical section 90, R is the radius of curvature of the spherical section 90, $N_I$ is the index of refraction of the material from which the lens area 52 is fabricated and $N_E$ is the index of refraction of the material surrounding the outer surface of the lens area 52. For an environment of air, $N_E = 1.000$ and for a lens area 52 in a specific embodiment fabricated from a polycarbonate material $N_I = 1.586$. The result is a height to radius ratio, $h/R = 0.22382$. The above formula is derived on the basis of the angle $\theta_E$ of the rays emerging from the lens area 52 being less than or equal to 90°. This ensures that regardless of the angle of incidence $\theta_I$ the emerging ray will be refracted and not internally reflected back into the lens area 52. The angle of incidence $\theta_I$ is the angle formed by the incident light ray and a line perpendicular to the surface (spherical section 90) at the point of intersection between the incident ray and the surface. The angle $\theta_E$ formed by the emerging or refracted ray represents the angle formed between the emerging ray and the perpendicular to the surface.

The assembled display array 10 in a specific embodiment is mounted by an array of spaced expandable mounting pins extending from a vertical mounting arrangement (not shown). The mounting pins are aligned with and extend through the holes 34 in the printed circuit card 12 and into the circular recesses 36 in the illumination source alignment and mounting array 16.

In one specific embodiment, the character generation control circuitry to drive and control the display array 10 is connected to the printed circuit card 12 through an edge connector arranged to interfit with conductive plating paths or fingers at an edge of the printed circuit card that extends beyond the illumination source alignment and mounting array 16. In another specific embodiment, the character generator control circuitry is connected to the printed circuit card 12 through connector pins inserted into and extending from the bottom surface of the printed circuit card 12.

While there has been illustrated and described several embodiments of the present invention, it will be apparent that various changes and modifications thereof will occur to those skilled in the art. It is intended in the appended claims to cover all such changes and modifications as fall within the true spirit and scope of the present invention.

We claim:

1. A generally planar lens for a display device comprising a plurality of spherical portion means arranged in a predetermined pattern and protruding from the front viewed surface of the lens for receiving a generally collimated illumination beam of light rays, for dispersing said generally collimated illumination beam over a predetermined volume defined by a viewing angle about a central axis through said lens, for distributing said illumination beam in a substantially uniform manner over a first predetermined portion of said predetermined volume, and for providing a predetermined degree of on-axis concentration of light output along said central axis, said predetermined pattern of integrally formed spherical portion means comprising a first pattern portion defined by a circular area of predetermined diameter centered about said central axis and a second pattern portion defined by the lens surface outside of said circular area, each of said first and second pattern portions including a predetermined spacing of said spherical portion means and a predetermined ratio of the radius of curvature and the height of each of said spherical portion means determined in accordance with said predetermined viewing angle and the distribution of said illumination beam, said ratio being calculated by maximizing the percentage of said illumination beam being transmitted out said lens and by maximizing the dispersion of said transmitted light.

2. The lens of claim 1 wherein said height and radius of curvature of each of said spherical portion means is the same for both said first and second pattern portions, said predetermined spacing of said spherical portion means in each of said first and second pattern portions being equal to provide an increased concentration of on-axis light output along said central axis.

3. The lens of claim 2 wherein said predetermined spacing of said spherical portion means is approximately equal to the diameter of each of said spherical portion means along said generally planar lens surface.

4. The lens of claim 1 wherein said height and radius of curvature of each of said spherical portion means is the same for both said first and second pattern portions, said predetermined spacing of said spherical portion means in said first pattern portion being less than said predetermined spacing of said spherical portion means in said second pattern portion to provide a substantially equal distribution of light output over said predetermined volume defined by said viewing angle about said central axis.

5. The lens of claim 4 wherein said predetermined spacing in said second pattern portion is approximately equal to the diameter of each spherical portion means along said generally planar lens surface.

* * * * *